US009038505B2

(12) United States Patent
He

(10) Patent No.: US 9,038,505 B2
(45) Date of Patent: May 26, 2015

(54) WRENCH

(71) Applicant: Ya-Lan He, Taichung (TW)

(72) Inventor: Ya-Lan He, Taichung (TW)

( * ) Notice: Subject to any disclaimer, the term of this patent is extended or adjusted under 35 U.S.C. 154(b) by 183 days.

(21) Appl. No.: 13/952,617

(22) Filed: Jul. 28, 2013

(65) Prior Publication Data

US 2015/0027276 A1 Jan. 29, 2015

(51) Int. Cl.

| | |
|---|---|
| ***B25B 17/00*** | (2006.01) |
| ***B25B 13/46*** | (2006.01) |
| ***B25B 13/48*** | (2006.01) |
| *B25B 21/00* | (2006.01) |
| *B25B 15/04* | (2006.01) |

(52) U.S. Cl.

CPC ..... *B25B 13/467* (2013.01); *B25B 17/00* (2013.01); *B25B 13/481* (2013.01); *B25B 21/00* (2013.01); *B25B 13/468* (2013.01); *B25B 13/465* (2013.01); *B25B 15/04* (2013.01); *B25B 13/463* (2013.01)

(58) Field of Classification Search

CPC .... B25B 17/00; B25B 13/467; B25B 13/481; B25B 21/00; B25B 13/465; B25B 13/463; B25B 15/04; B25B 13/468; B25B 23/0035

USPC ..... 81/57.29, 57.22, 58.2, 58.3, 453, 61

See application file for complete search history.

(56) References Cited

U.S. PATENT DOCUMENTS

| | | | | |
|---|---|---|---|---|
| 6,070,499 | A * | 6/2000 | Wisbey | 81/57.29 |
| 6,257,096 | B1 * | 7/2001 | Ling | 81/60 |
| 6,311,584 | B1 * | 11/2001 | Chu | 81/57.29 |
| 6,457,386 | B1 * | 10/2002 | Chiang | 81/62 |
| 6,568,299 | B2 * | 5/2003 | Hu | 81/63.2 |
| 6,971,284 | B2 * | 12/2005 | Owoc | 81/58.2 |
| 7,069,818 | B1 * | 7/2006 | Huang | 81/57.29 |
| 7,104,165 | B2 * | 9/2006 | Chu | 81/177.8 |
| 7,181,996 | B1 * | 2/2007 | Chu | 81/57.29 |
| 7,267,033 | B1 * | 9/2007 | Lai | 81/57.29 |
| 7,444,902 | B1 * | 11/2008 | Lin et al. | 81/57.29 |
| 7,938,042 | B2 * | 5/2011 | Hu | 81/62 |
| 7,966,912 | B1 * | 6/2011 | Hobden et al. | 81/63 |

* cited by examiner

*Primary Examiner* — Monica Carter
*Assistant Examiner* — Danny Hong

(57) ABSTRACT

A wrench includes a body having a working end which has a first toothed portion, a first room, a second room, a third room and a first pivot cavity. The second and third rooms open through the top of the body. A driving unit is pivotably connected to the working end and has a first recess and a second recess for receiving a first pawl and a second pawl therein. The first pawl has teeth engaged with the first toothed portion, and the second pawl has teeth engaged with a second toothed portion of a first teeth disk in the first room. A second teeth disk is pivotably located in the second room and has a forth toothed portion which is engaged with a third toothed portion of the first teeth disk. A shaft is pivotably located in the third room and is connected to the second teeth disk.

11 Claims, 11 Drawing Sheets

WRENCH

FIELD OF THE INVENTION

The present invention relates to a wrench, and more particularly, to a wrench having less machining steps required.

BACKGROUND OF THE INVENTION

The conventional wrench is disclosed in U.S. Pat. No. 6,457,386 and comprises a main body, a drive shaft, a handle, a first annular gear, a second annular gear, a drive member, a pair of first pawls, a pair of second pawls, a rotating wheel, a control member, a plurality of balls, a plurality of compression springs, and a coiled spring. The main body has a through hole to receive the drive shaft, a pair of pivot holes, a groove to receive the drive member, a plurality of inner teeth, and the through hole communicating with the groove. The drive member has a through aperture and a chamber. The handle has a blind hole to receive the drive shaft. The first annular gear has a plurality of inner periphery serrations and a plurality of one-sided serrations. The second annular gear has a plurality of inner periphery teeth and a plurality of one-sided teeth. Each of the first pawls has a plurality of positioning recesses and a plurality of outer teeth. Each of the second pawls has a plurality of periphery serrations and a plurality of one-sided serrations. The rotating wheel has an oblong center hole. The control member has a pillar and a press disk disposed on the pillar. The pillar has a plurality of circular holes. Each of the circular holes of the pillar receives the corresponding compression spring and the corresponding ball. A pair of studs pass through the pivot holes of the main body and an annular recess of the drive shaft. The chamber of the drive member receives the first pawls and the second pawls. The first annular gear encloses one of the first pawls and one of the second pawls. The second annular gear encloses the other of the first pawls and the other of the second pawls. The pillar is inserted through the coiled spring, the oblong center hole of the rotating wheel, and the through aperture of the drive member. The coiled spring is disposed between the press disk and the rotating wheel, and each of the balls is engaged with one of the first pawls and the second pawls.

The main body has a through hole in which the drive shaft is pivotably located. However, the main body has a fixed length and the through hole has its length, the through hole is made by using a tool. Unfortunately, the cost for using the tool is by charged by the unit of mini-meter, so that when the length of the through hole has a certain length, cost for making the through hole will be high. Besides, the debris cannot be removed when making the through hole so that the drill of the tool may be broken during drilling.

Furthermore, the drive shafts and the through holes disclosed in FIGS. 1 and 4 of U.S. Pat. No. 6,457,386 have the similar problems.

SUMMARY OF THE INVENTION

The present invention relates to a wrench and comprises a body having a working end which has a first toothed portion, a first room, a second room, a third room and a first pivot cavity. The second and third rooms open through the top of the body. A driving unit is pivotably connected to the working end and has a first recess and a second recess for receiving a first pawl and a second pawl therein. The first pawl has teeth engaged with the first toothed portion, and the second pawl has teeth engaged with a second toothed portion of a first teeth disk in the first room. A second teeth disk is pivotably located in the second room and has a forth toothed portion which is engaged with a third toothed portion of the first teeth disk. A shaft has one end thereof pivotably located in the third room and is connected to the second teeth disk.

Compared with the conventional wrench, the second room and the third room are opened through the top of the wrench. The cap recess is located to cover the first room, the second room and a portion of the third room. The third room has a first pivot cavity at an end thereof and the first pivot cavity is an enclosed circular hole. The cap recess, the second and third rooms can be directly formed in the body by way of forging. Only the first pivot cavity is needed to be drilled and the depth of the first pivot cavity is not deep so that the cost for drilling the first pivot cavity is limited. The enclosed first pivot cavity is an enclosed circular hole so that the shaft is inserted in the third room via the first pivot cavity, the insertion is easy.

The primary object of the present invention is to provide a wrench which has a second room and a third room, each of the two rooms are opened through the top of the wrench, and a closed portion is located between the second and first rooms. Therefore, the manufacturing cost is reduced.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
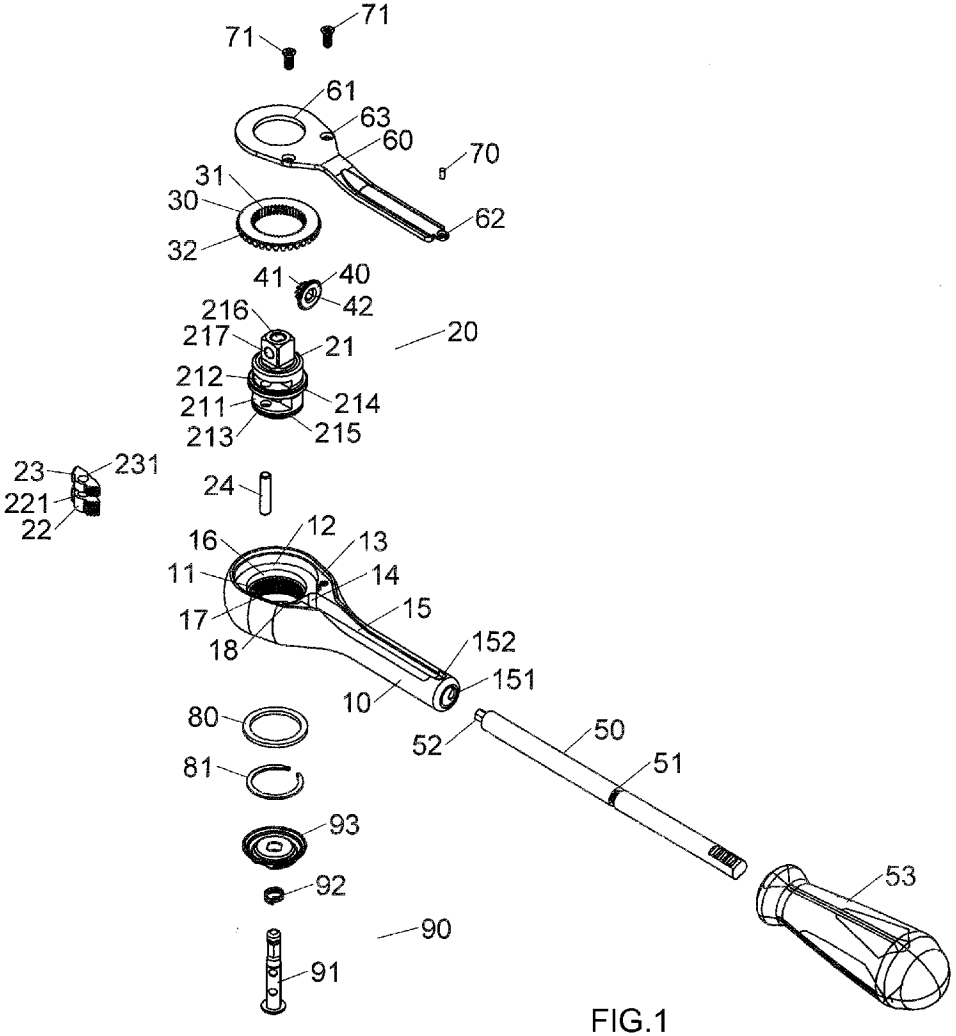
FIG. 1 is an exploded view to show the wrench of the present invention.

Referring to FIG. 1, the wrench of the present invention comprises a body 10 having a working end on one end thereof and the working end has a first toothed portion 11 and a first room 12 defined in the inner periphery thereof. The diameter of the first room 12 is larger than that of the first toothed portion 11. The first toothed portion 11 and the first room 12 share a common axis. The body 10 has a cap recess 13 defined in the top face thereof. A second room 14 is defined beside the first toothed portion 11 and communicates with the first room 12. The second room 14 is not in communicating with the first toothed portion 11. A third room 15 is defined in the body 10 and located away from the first toothed portion 11. The third room 15 communicates with the second room 14. The second and third rooms 14, 15 both are opened through the top of the body 10. The cap recess 13 is located corresponding to the first, second and third rooms 12, 14, 15. A first pivot cavity 151 is defined in one end of the body 10 and located opposite to the second room 14. The first pivot cavity 151 is a closed circular hole. A first restriction portion 152 is formed in the body 10 and located close to the first pivot cavity 151 and is a slot. A first periphery 16 is defined in the inner periphery of the working end and located above the first toothed portion 11. The diameter of the first periphery 16 is larger than that of the first toothed portion 11, and is less than that of the first room 12. The first periphery 16 is located between the first toothed portion 11 and the first room 12. A second periphery 17 is defined in the inner periphery of the working end and located beneath the first toothed portion 11. The diameter of the second periphery 17 is larger than that of the first toothed portion 11. The diameter of the second periphery 17 is the same as the diameter of the first periphery 16. Multiple fixing holes 18 are defined in the top of the body 10 and located within the area of the cap recess 13. The fixing holes 18 are threaded holes. In this embodiment, there are two fixing holes 18.

A driving unit 20 is pivotably located in the working end of the body 10 and has a driving head 21, a first pawl 22, a second pawl 23 and a pin 24.

The driving head 21 is pivotably connected to the working end of the body 10 and has a first recess 211 and a second recess 212 which is located beneath the first recess 211. The driving head 21 has a first pivot hole 213 which communicates with the first and second recesses 211, 212. The driving head 21 has a contact portion 214 which is a flange and located between the first and second recesses 211, 212. The contact portion 214 is pivotably connected to the first periphery 16. The driving head 21 has a groove 215 defined in the periphery thereof. A rectangular protrusion extends from the driving head 21. The driving head 21 has a first through hole 216 defined therethrough, and a bead 217 is engaged with the driving head 21.

The first pawl 22 is located in the first recess 211 and has teeth formed in two ends thereof respectively. The teeth of the two ends of the first pawl 22 are engaged with the first toothed portion 11 of the body 10 respectively. A second pivot hole 221 is defined in the middle portion of the first pawl 22.

The second pawl 23 IS located in the second recess 212 and has teeth formed in two ends thereof respectively. A third pivot hole 231 is defined in the middle portion of the second pawl 23. The thickness of the second pawl 23 is less than that of the first pawl 22.

The pin 24 extends through the first pivot hole 213, the second pivot hole 221 and the third pivot hole 231.

A first teeth disk 30 is pivotably located in the first room 12 of the body 10 and has a second toothed portion 31 which is engaged with the teeth on the two ends of the second pawl 23 respectively. The two respective diameters of the second toothed portion 31 and the first toothed portion 11 are the same. The second toothed portion 31 and the first toothed portion 11 have the same number of teeth. The first teeth disk 30 has a third toothed portion 32 which are inclined teeth or radial teeth. The second toothed portion 31 faces the first toothed portion 11.

A second teeth disk 40 is pivotably located in the second room 14 of the body 10 and has a fourth toothed portion 41 which is engaged with the third toothed portion 32 of the first teeth disk 30. The axis of the second teeth disk 40 is substantially perpendicular to an axis of the first teeth disk 30. The second teeth disk 40 has a first connection portion 42 which is a hexagonal recess.

A shaft 50 is located in the third room 15 via the first pivot cavity 151 and has a second restriction portion 51 which is an annular groove. The shaft 50 has a second connection portion 52 at the first end thereof and the second connection portion 52 is connected with the first connection portion 42 of the second teeth disk 40. The second connection portion 52 is a hexagonal rod which is inserted in the first connection portion 42.

A grip 53 is connected to the second end of the second connection portion 52, and the grip 53 is pivotably connected to the first pivot cavity 151 of the body 10.

A cap 60 is engaged with the cap recess 13 to restrict the driving unit 20, the first teeth disk 30, the second teeth disk 40 and the first end of the shaft 50 in the body 10. The cap 60 has a central hole 61 through which the rectangular protrusion of the driving head 21 of the driving unit 20 extends. A third restriction portion 62 is a recess and defined in one end of the cap 60. The cap 60 has two second fixing holes 63 which are through holes. The number of the second fixing holes 63 is the same as that of the first fixing holes 18.

A restriction member 70 extends through the third restriction portion 62 of the cap 60, the first restriction portion 152 of the body 10 and is engaged with the second restriction portion 51 of the shaft 50. The shaft 50 is restricted by the restriction member 70 so that the shaft 50 is pivotably located in the pivot hole 15. The restriction member 70 and the third restriction portion 62 of the cap 60 are hidden in the grip 53. The restriction member 70 is restricted by the grip 53 such that the restriction member 70 does not drop from the body 10.

Multiple bolts 71 extend through the second fixing holes 63 and are threadedly connected to the first fixing holes 18 to connect the cap 60 to the cap recess 13. The first and second fixing holes 18, 63 and the bolts 71 have the identical number.

A washer 80 is located at the second periphery 17 of the body 10.

A clip 81 is engaged with the groove 215 of the driving head 21 and contacts the washer 81, so that the driving unit 20 is pivotably connected to the working end of the body 10.

A quick-release unit 90 is located in the first through hole 216 and pivotable in the first through hole 216 so as to control the first and second pawls 22, 23 to be pivoted an angle about the pin 24. The teeth on the two ends of the first pawl 22 are respectively engaged with the first toothed portion 11 to allow the wrench to be rotated in two different directions, and to control the teeth on the two ends of the second pawl 23 to be engaged with the second toothed portion 31 of the first teeth disk 30 respectively. The quick-release unit 90 comprises a control rod 91, a resilient member 92 and a control disk 93.

The control rod 91 extends through the first through hole 216 and has a notch which is located corresponding to the bead 217. The control rod 91 has a push end at one end thereof.

The resilient member 92 is mounted to the control rod 91. The control disk 93 is mounted to the working end and has a knurled surface. The control disk 93 has a non-circular hole through which the control rod 91 extends. The resilient member 92 is located between the push end of the control rod 91 and the control disk 93. When the control disk 93 is rotated, the control disk 93 drives the control rod 91 to be rotated an angle in the first through hole 216 of the driving head 21 so as to push the first pawl 22 and the second pawl 23.

Figure 2:
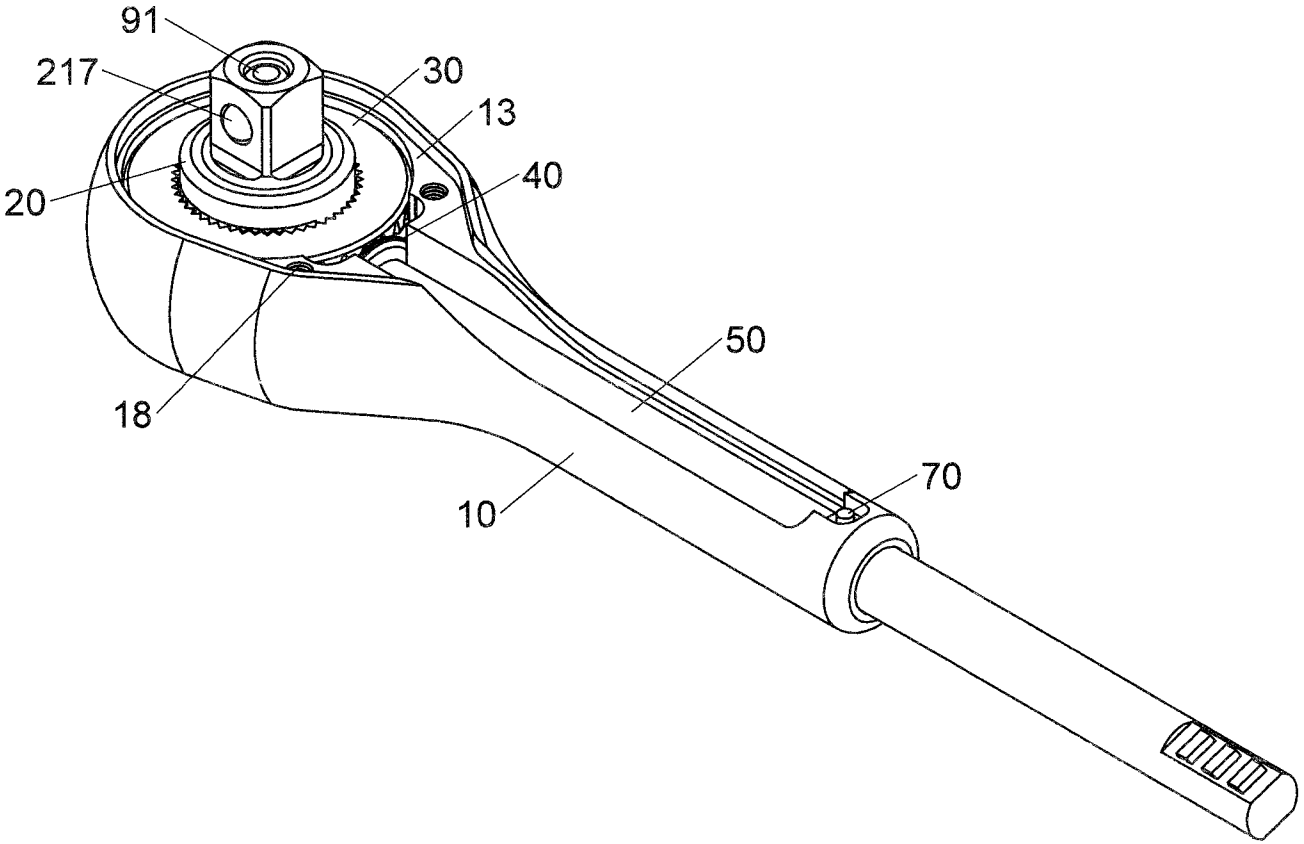
FIG. 2 is a perspective view to show a portion of the wrench of the present invention.

When assembling, the driving head 21, the first pawl 22, the second pawl 23 and the pin 24 are assembled to form the driving unit 20 which is pivotably connected to the working end of the body 10. The teeth on one end of the first pawl 22 are engaged with the first toothed portion 11. The second teeth disk 40 is pivotably located in the second room 14, and the first teeth disk 30 is pivotably located in the first room 12. The second toothed portion 31 is engaged with the teeth on one end of the second pawl 23, and the third toothed portion 32 is engaged with the fourth toothed portion 41. The shaft 50 is inserted into the third room 15 via the first pivot cavity 151, and then is connected with the second teeth disk 40. The restriction member 70 is located in the first and second restriction portions 152, 51 to form the combination as shown in FIG. 2.

Figure 3:
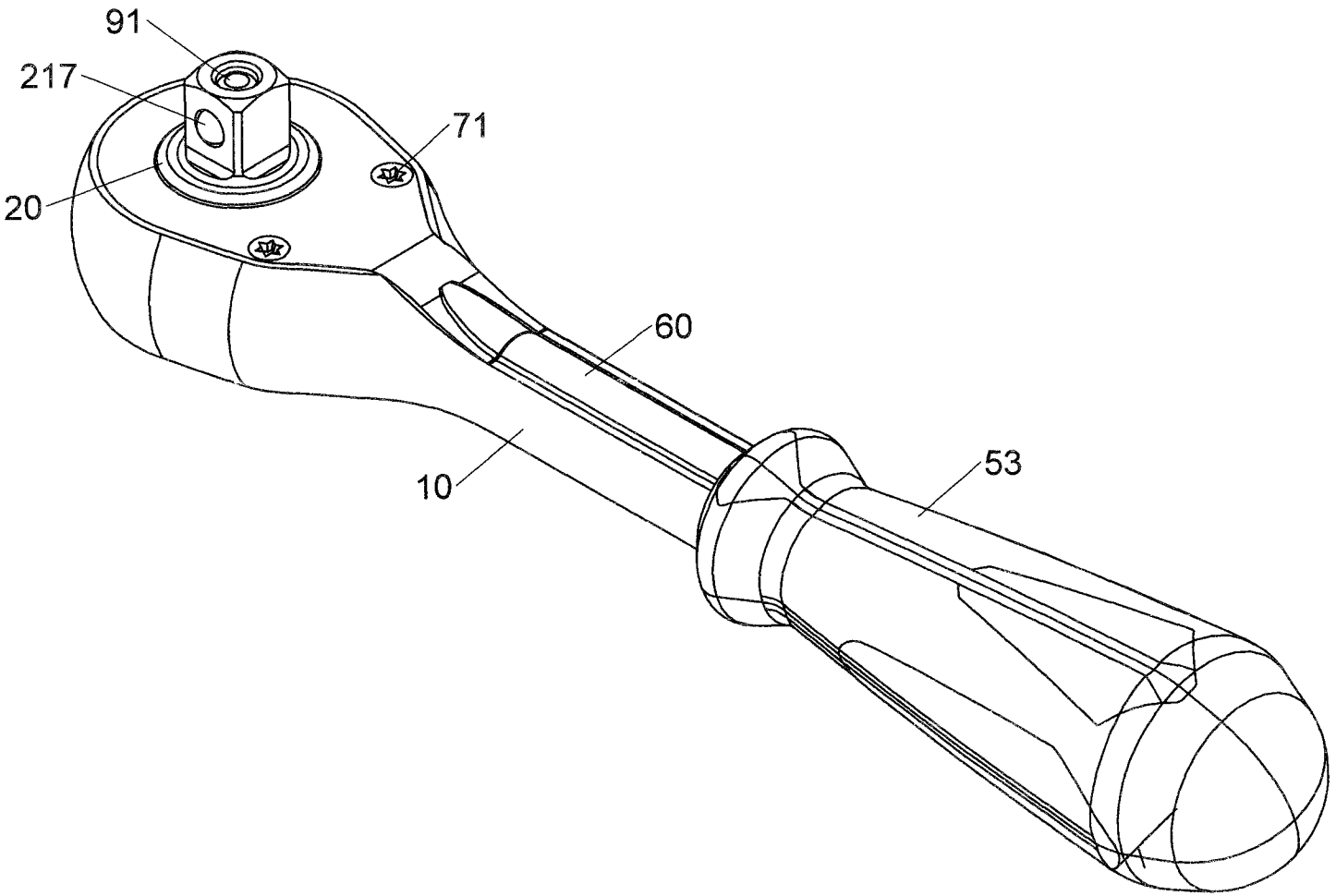
FIG. 3 is a perspective view to show the wrench of the present invention.
Figure 4:
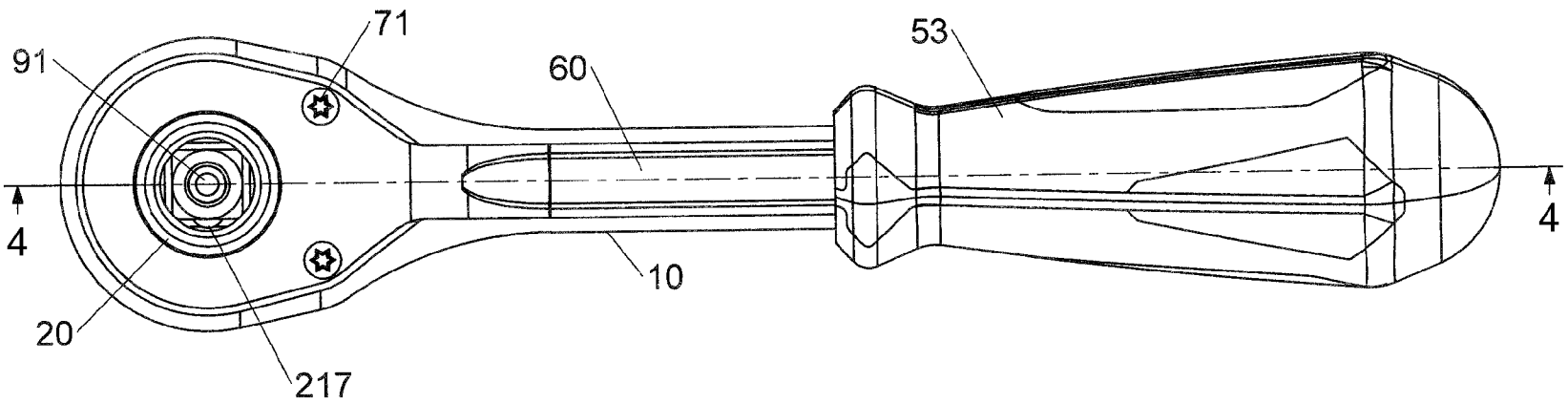
FIG. 4 is a top view to show the wrench of the present invention.
Figure 5:
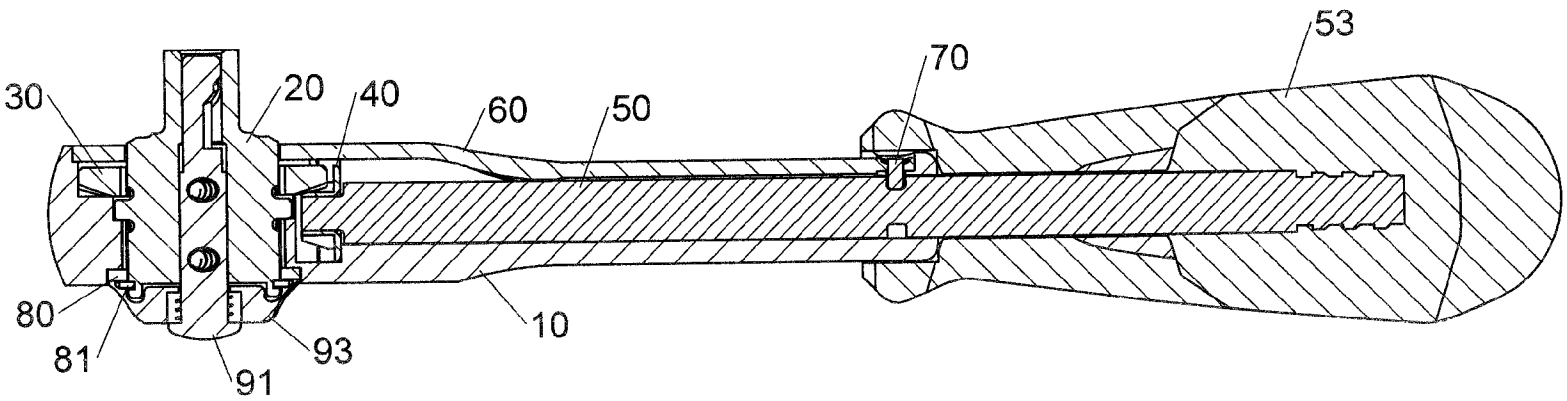
FIG. 5 is a cross sectional view, taken along line 4-4 in FIG. 4.
Figure 6:
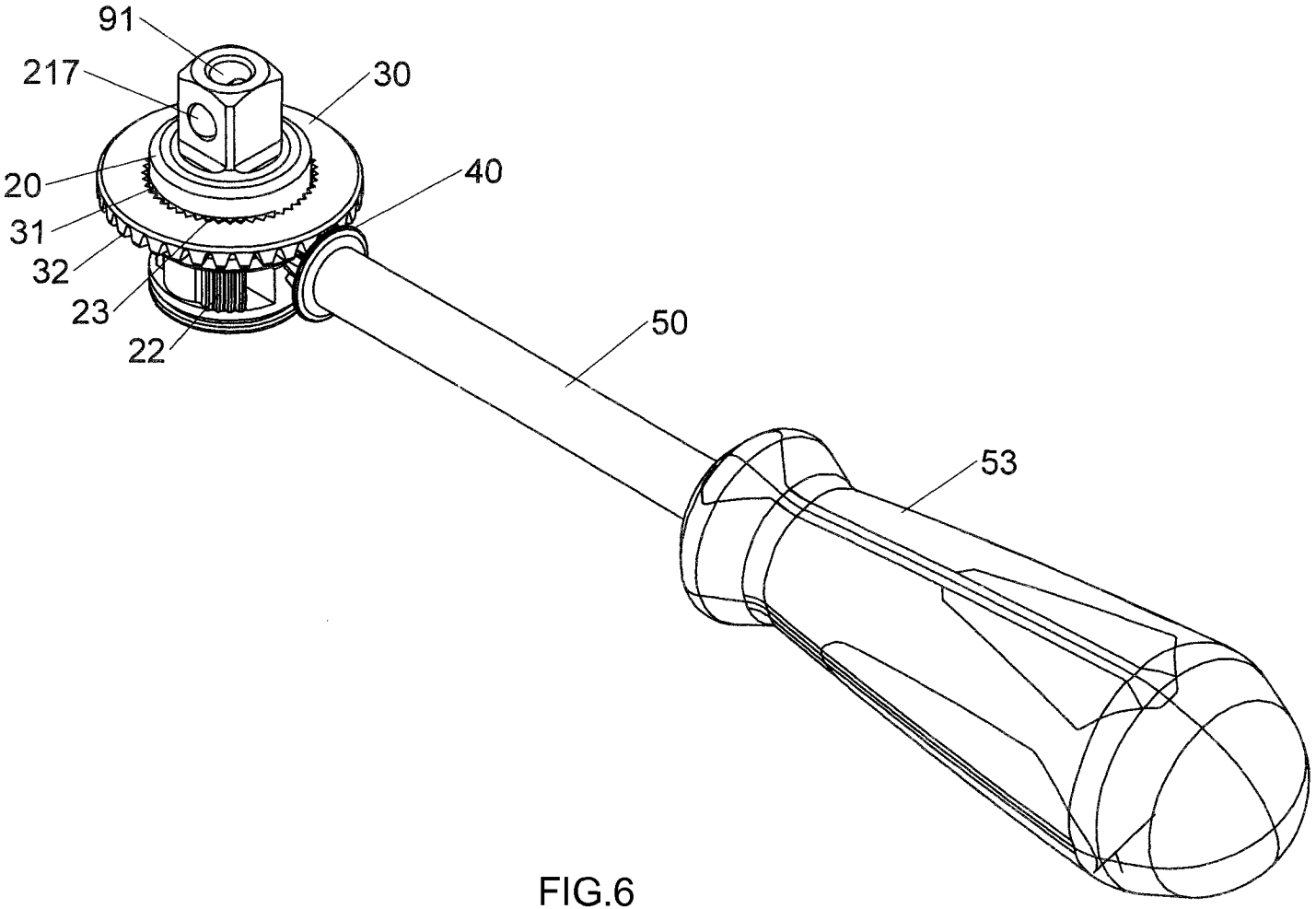
FIG. 6 shows that the wrench of the present invention is rotated.
Figure 7:
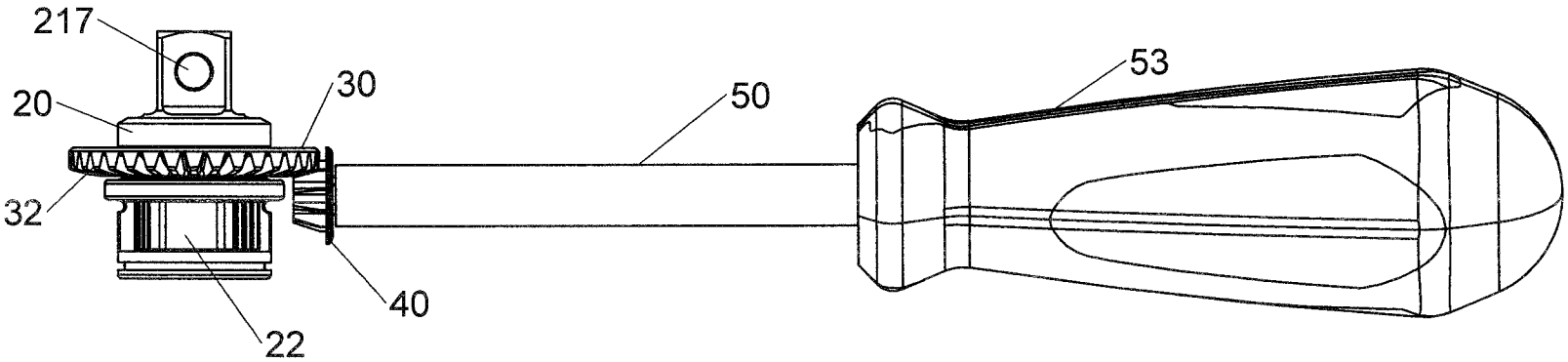
FIG. 7 is a side view to show that the wrench of the present invention is rotated.

The cap 60 is engaged with the cap recess 13 and the bolts 71 are connected to the first fixing holes 18, the washer 80 is located at the second periphery 17. The clip 81 is engaged with the groove 215 of the driving head 21. The quick-release unit 90 is installed to the driving unit 20. The grip 53 is connected to the end of the shaft 50 and covers up the restriction member 70 and a portion of the cap 60 as shown in FIG. 3.

As shown in FIGS. 4 to 7, the teeth on one end of the second pawl 23 are engaged with the second toothed portion 31 and the third toothed portion 32 is engaged with the fourth toothed portion 41 of the second teeth disk 40.

Figure 8:
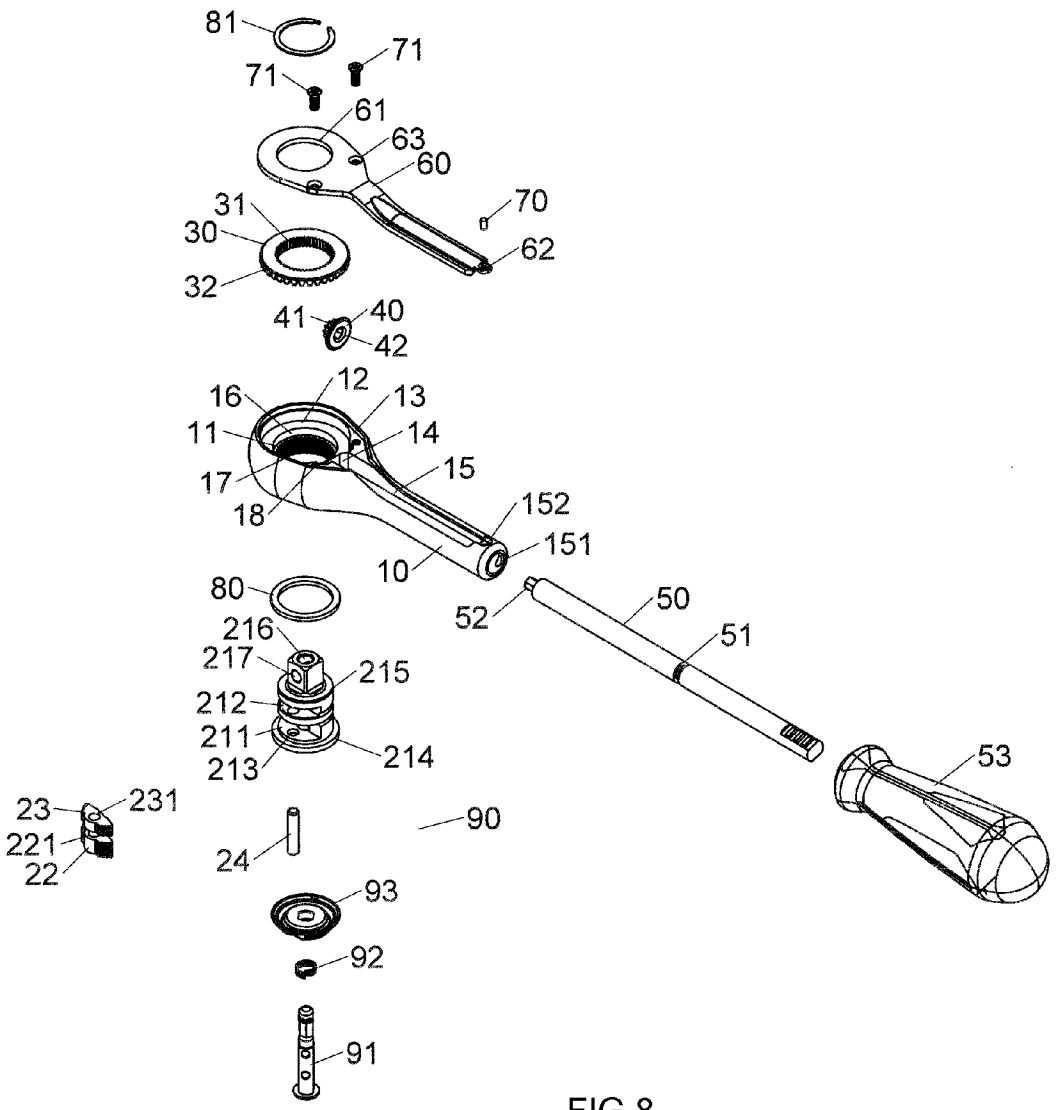
FIG. 8 is an exploded view to show the second embodiment of the wrench of the present invention.
Figure 9:
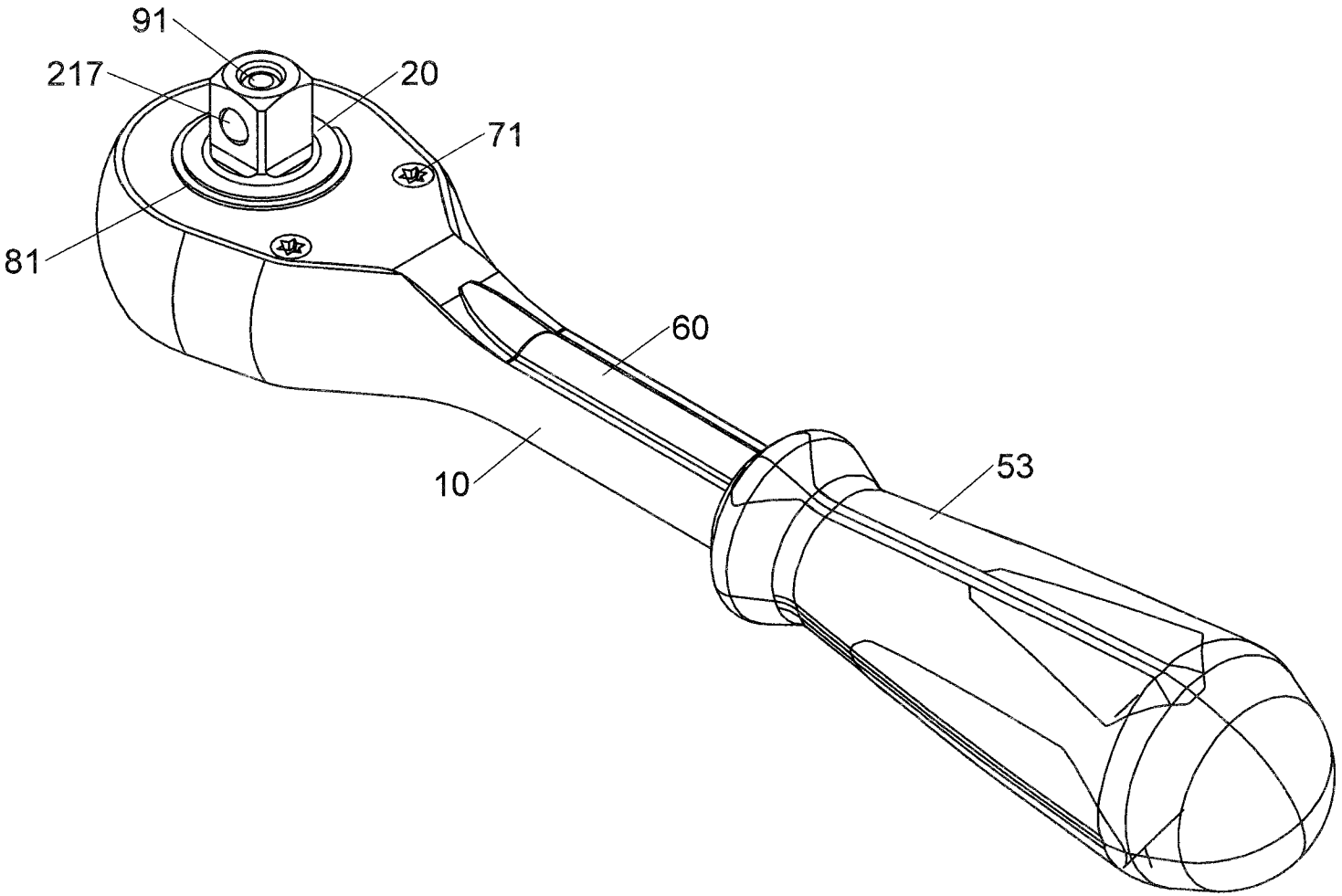
FIG. 9 is a perspective view to show the second embodiment of the wrench of the present invention.

As shown in FIGS. 8 and 9, the second embodiment shows that the contact portion 214 of the driving head 21 is located at the end of the driving head 21 and contacts the second periphery 17 of the body 10 or the washer 80. The groove 215 of the driving head 21 is located at the rectangular protrusion and the clip 81 is engaged with the groove 215 and contacts the cap 60. As shown in FIG. 1, the driving unit 20 is installed to the body 10 from the top to the bottom of the body 10. As shown in FIG. 8, the driving unit 20 is installed to the body 10 from the bottom to the top of the body 10.

Figure 11:
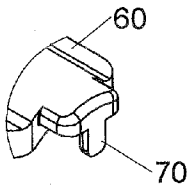
FIG. 11 is an enlarged view to show the circled B in FIG. 10.
Figure 10:
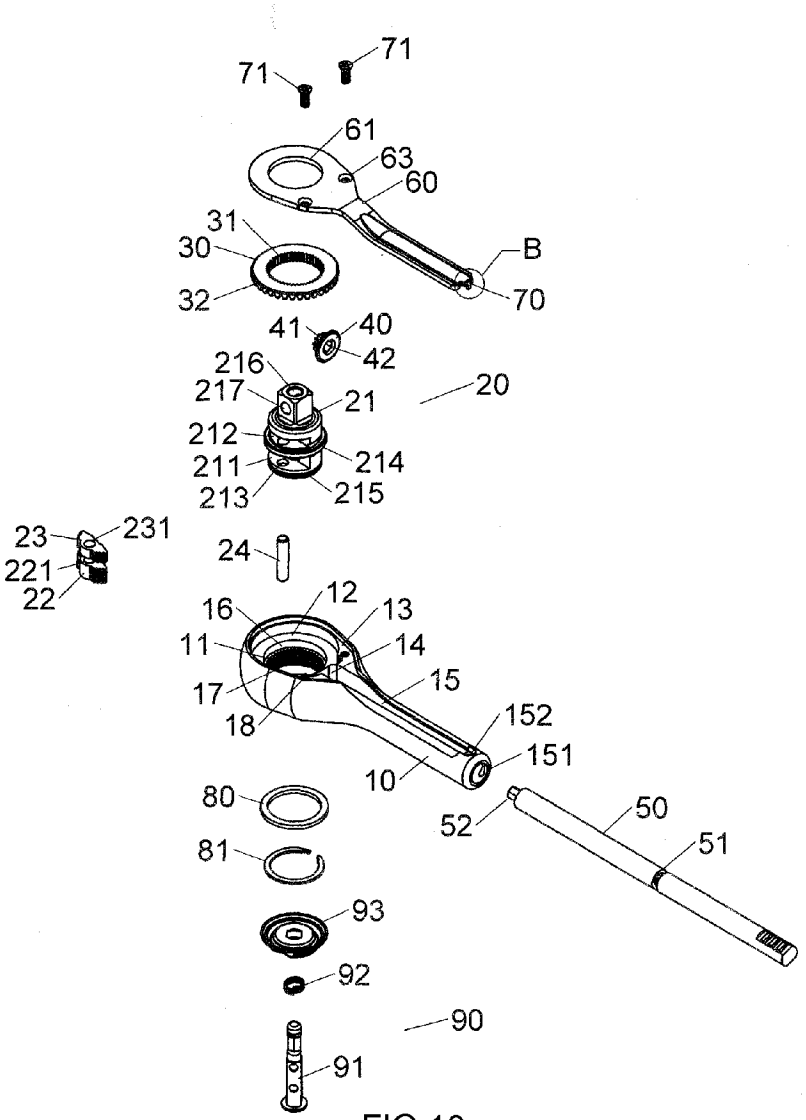
FIG. 10 is an exploded view to show the third embodiment of the wrench of the present invention.

As shown in FIGS. 10 and 11, the restriction member 70 and the cap 60 are integrally formed as a one-piece member. The cap 60 does not have the third restriction portion 62, the restriction member 70 extends from the cap 60.

Figure 12:
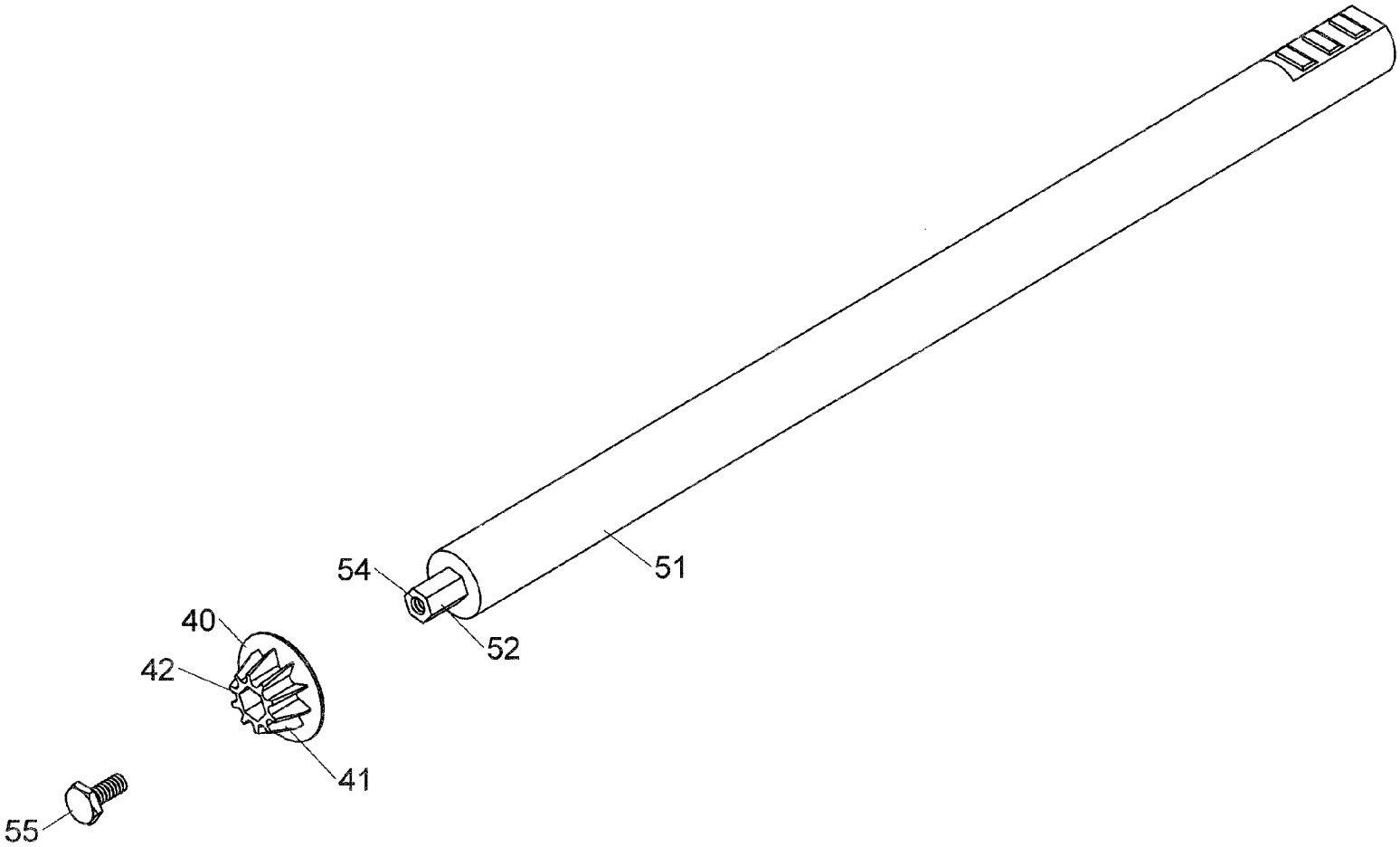
FIG. 12 is an exploded view to show the fourth embodiment of the wrench of the present invention.

As shown in FIG. 12, the shaft 50 has a threaded hole 54 defied in the connection portion 52 and a bolt 55 is threadedly connected to the threaded hole 54 of the shaft 50 so as to connect the shaft 50 to the second teeth disk 40. The shaft 50 is pivotably located in the third room 15 by the second teeth disk 40. Therefore, the body 10 does not have the first restriction portion 152 and the shaft 50 does not have the second restriction portion 51, and the cap 60 does not have the third restriction portion 62, and there will be no restriction member 70.

Figure 13:
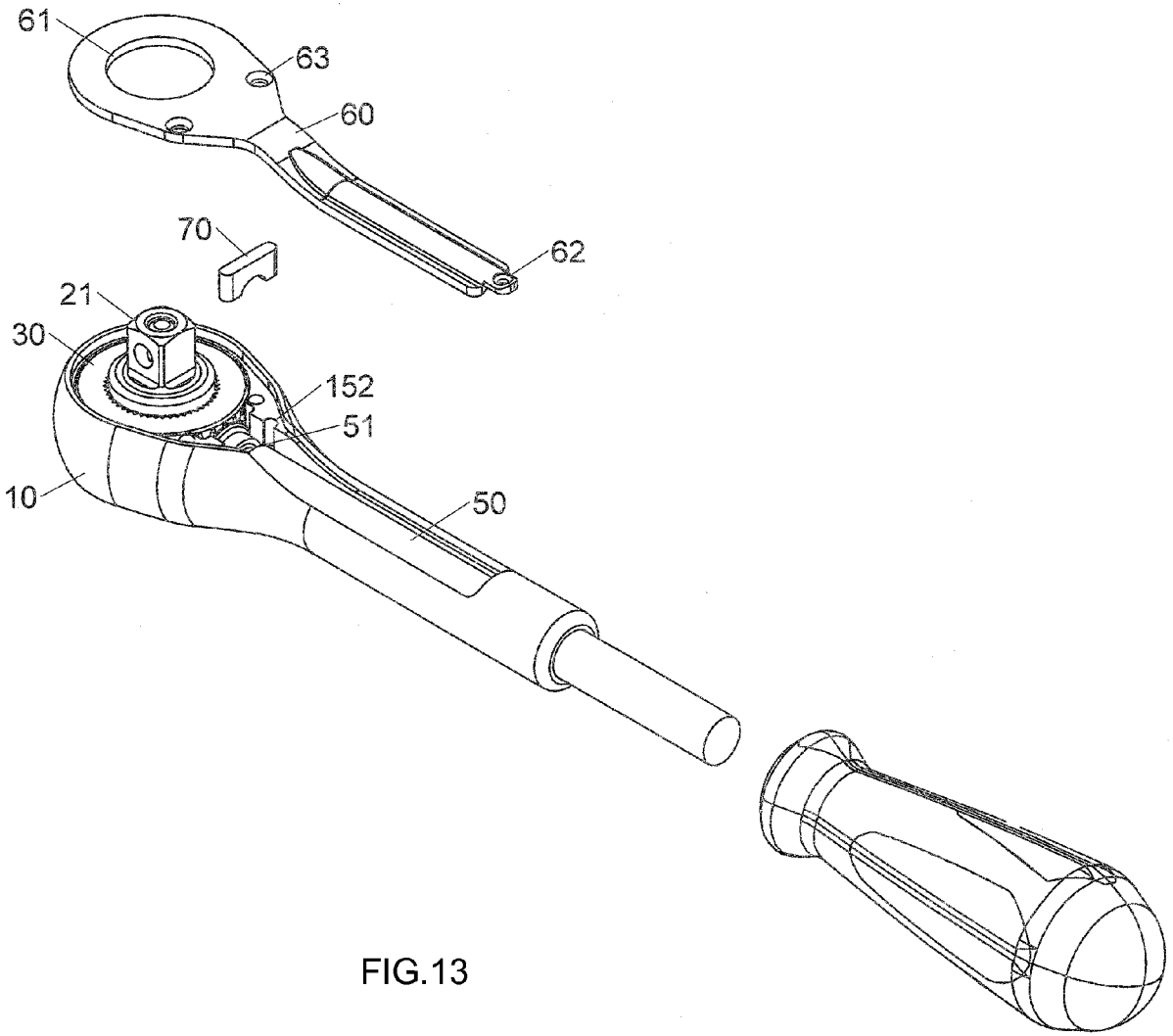
FIG. 13 is an exploded view to show the fifth embodiment of the wrench of the present invention.

As shown in FIG. 13, the first restriction portion 152 of the body 10 is a slot and the second restriction portion 51 of the shaft 50 is located corresponding to the first restriction portion 152. The restriction member 70 is received in the first restriction portion 152 and contacts the second restriction portion 51 so as to pivotably connect the shaft 50 in the first pivot cavity 151.

The second room 14 and the third room 15 are opened through the top of the wrench. The cap recess 13 is located to cover the first room 12, the second room 14 and a portion of the third room 15. The third room 15 has a first pivot cavity 151 at one end thereof and the first pivot cavity 151 is an enclosed circular hole. The cap recess 13, the second and third rooms 14, 15 can be directly formed in the body 10 by way of forging. Only the first pivot cavity 151 is needed to be drilled and the depth of the first pivot cavity 151 is not deep so that the cost for drilling the first pivot cavity 151 is limited.

The enclosed first pivot cavity 151 is an enclosed circular hole so that the shaft 50 is inserted in the third room 15 via the first pivot cavity 151. The shaft 50 is pivotably located in the third room 15. The connection between the shaft 50 and the body 10 is easy.

The restriction member 70 extends through the third restriction portion 62 of the cap 60, the first restriction portion 152 of the body 10, and is located at the second restriction portion 51 of the shaft 50. The shaft 50 is restricted by the restriction member 70 so that the shaft 50 is well located in the third room 15.

The restriction member 70 and the third restriction portion 62 of the cap 60 are hidden by the grip 53, the restriction member 70 is restricted by the grip 53 and does not drop from the grip 53.

The cap 60 is engaged with the cap recess 13, the bolts 71 are connected to the first fixing hole s18. The grip 53 is connected to the end of the shaft 50 and the first pivot cavity 151 of the body 10. The grip 53 covers the restriction member 70 and the rear end of the cap 60. The cap 60 is connected to the body 10 by the restriction member 71 and the grip 53.

While we have shown and described the embodiment in accordance with the present invention, it should be clear to those skilled in the art that further embodiments may be made without departing from the scope of the present invention.

What is claimed is:

1. A wrench comprising:

a body having a working end on one end thereof and the working end having a first toothed portion and a first room defined in an inner periphery thereof, a diameter of the first room being larger than that of the first toothed portion, the first toothed portion and the first room sharing a common axis, the body having a cap recess defined in a top face thereof, a second room defined beside the first toothed portion and communicating with the first room, the second room being not in communicating with the first toothed portion, a third room defined in the body and located away from the first toothed portion, the third room communicating with the second room, the second and third rooms both being opened through the top of the body, the cap recess located corresponding to the first, second and third rooms, a first pivot cavity defined in an end of the body and located opposite to the second room, the first pivot cavity being a closed circular hole, a first restriction portion formed in the body and located close to the first pivot cavity and being a slot, a first periphery defined in the inner periphery of the working end and located above the first toothed portion, a diameter of the first periphery being larger than that of the first toothed portion, and being less than that of the first room, the first periphery located between the first toothed portion and the first room, a second periphery defined in the inner periphery of the working end and located beneath the first toothed portion, a diameter of the second periphery being larger than that of the first toothed portion, the diameter of the second periphery being the same as the diameter of the first periphery;

a driving unit pivotably located in the working end of the body and having a driving head, a first pawl, a second pawl and a pin, the driving head pivotably connected to the working end of the body and having a first recess and a second recess which is located beneath the first recess, the driving head having a first pivot hole which communicates with the first and second recesses, the driving head having a contact portion which is a flange and located between the first and second recesses, the contact portion being pivotably connected to the first periphery, the driving head having a groove defined in a periphery thereof, a rectangular protrusion extending from the driving head;

the first pawl located in the first recess and having teeth formed in two ends thereof respectively, the teeth of the two ends of the first pawl engaged with the first toothed portion of the body respectively, a second pivot hole defined in a middle portion of the first pawl;

the second pawl located in the second recess and having teeth formed in two ends thereof respectively, a third pivot hole defined in a middle portion of the second pawl;

the pin extending through the first pivot hole, the second pivot hole and the third pivot hole;

a first teeth disk pivotably located in the first room of the body and having a second toothed portion which is engaged with the teeth on the two ends of the second pawl respectively, two respective diameters of the second toothed portion and the first toothed portion being the same, the second toothed portion and the first toothed portion having the same number of teeth, the first teeth disk having a third toothed portion, the second toothed portion facing the first toothed portion;

a second teeth disk pivotably located in the second room of the body and having a fourth toothed portion which is engaged with the third toothed portion of the first teeth disk, the second teeth disk having a first connection portion which is a hexagonal recess;

a shaft located in the third room via the first pivot cavity and having a second restriction portion which is an annular groove, the shaft having a second connection portion at a first end thereof and the second connection portion being connected with the first connection portion of the second teeth disk, the second connection portion being a hexagonal rod which is inserted in the first connection portion;

a grip connected to a second end of the second connection portion, the grip pivotably connected to the first pivot cavity of the body;

a cap engaged with the cap recess to restrict the driving unit, the first teeth disk, the second teeth disk and the first end of the shaft in the body, the cap having a central hole through which the rectangular protrusion of the driving head of the driving unit extends, a third restriction portion being a recess and defined in an end of the cap;

a restriction member extending through the third restriction portion of the cap, the first restriction portion of the body and engaged with the second restriction portion of the shaft, the shaft being restricted by the restriction member so that the shaft is pivotably located in the pivot hole, the restriction member and the third restriction portion of the cap being hidden in the grip, the restriction member being restricted by the grip such that the restriction member does not drop from the body;

a washer located at the second periphery of the body, and a clip engaged with the groove of the driving head and contacting the washer.

2. The wrench as claimed in claim 1, wherein multiple fixing holes are defined in the top of the body and located within an area of the cap recess, the fixing holes are threaded holes, the cap has multiple second fixing holes which are through holes, multiple bolts extend through the second fixing holes and are threadedly connected to the first fixing holes to connect the cap to the cap recess, the first and second fixing holes and the bolts having an identical number.

3. The wrench as claimed in claim 1, wherein the driving head has a first through hole defined therethrough, a bead is engaged with the driving head, a quick-release unit located in the first through hole and pivotable in the first through hole so as to control the first and second pawls to be pivoted an angle about the pin, the teeth on the two ends of the first pawl are respectively engaged with the first toothed portion so that the wrench is able to be rotated in two different directions, and to control the teeth on the two ends of the second pawl to be engaged with the second toothed portion of the first teeth disk respectively.

4. The wrench as claimed in claim 3, wherein the quick-release unit comprises a control rod, a resilient member and a control disk, the control rod extends through the first through hole and has a notch which is located corresponding to the bead, the control rod has a push end at an end thereof, the resilient member mounted to the control rod, the control disk is mounted to the working end and has a knurled surface, the control disk has a non-circular hole through which the control rod extends, the resilient member is located between the push end of the control rod and the control disk, when the control disk is rotated, the control disk drives the control rod to be rotated an angle in the first through hole of the driving head so as to push the first pawl and the second pawl.

5. The wrench as claimed in claim 1, wherein a thickness of the second pawl is smaller than that of the first pawl.

6. The wrench as claimed in claim 1, wherein the third toothed portion are inclined teeth or radial teeth.

7. The wrench as claimed in claim 1, wherein an axis of the second teeth disk is substantially perpendicular to an axis of the first teeth disk.

8. The wrench as claimed in claim 1, wherein the contact portion of the driving head is located at an end of the driving head and contacts the second periphery of the body, the groove of the driving head is located at the rectangular protrusion, the clip is engaged with the groove and contacts the cap.

9. The wrench as claimed in claim 1, wherein the restriction member and the cap are integrally formed as a one-piece member, the cap does not have the third restriction portion, the restriction member extends from the cap.

10. The wrench as claimed in claim 1, wherein the shaft has a threaded hole defied in the connection portion and a bolt is threadedly connected to the threaded hole of the shaft so as to connect the shaft to the second teeth disk, the shaft is pivotably located in the third room by the second teeth disk.

11. The wrench as claimed in claim 1, wherein the first restriction portion of the body is a slot and the second restriction portion of the shaft is located corresponding to the first restriction portion, the restriction member is received in the first restriction portion and contacts the second restriction portion so as to pivotably connect the shaft in the first pivot cavity.

* * * * *